US006241202B1

(12) United States Patent
Chen

(10) Patent No.: US 6,241,202 B1
(45) Date of Patent: Jun. 5, 2001

(54) SUPPORTING DEVICE FOR A GOLF BAG

(76) Inventor: Chiu-Teh Chen, 4F, No. 12, Alley 28, Lane 81, Section 7, Chung Shan North Road, Shih Lin, Taipei (TW)

( * ) Notice: Subject to any disclaimer, the term of this patent is extended or adjusted under 35 U.S.C. 154(b) by 0 days.

(21) Appl. No.: 09/448,346

(22) Filed: Nov. 23, 1999

(51) Int. Cl.[7] ..... A63B 55/00
(52) U.S. Cl. ..... 248/96; 206/315.7
(58) Field of Search ..... 248/96; 206/315.3, 206/315.7; 280/646; 180/65.1

(56) References Cited

U.S. PATENT DOCUMENTS

| | | | | |
|---|---|---|---|---|
| 5,549,263 | * | 8/1996 | Maeng | 248/96 |
| 5,673,879 | * | 10/1997 | Hsieh | 248/96 |
| 5,823,485 | * | 10/1998 | Park | 248/96 |
| 5,860,521 | * | 1/1999 | Wu | 206/315.7 |
| 5,887,833 | * | 3/1999 | Sundara et al. | 248/96 |
| 6,062,383 | * | 5/2000 | Han | 206/315.7 |

* cited by examiner

*Primary Examiner*—Ramon O. Ramirez
(74) *Attorney, Agent, or Firm*—Alan Kamrath; Rider, Bennett, Egan & Arundel, LLP

(57) ABSTRACT

A supporting device for a golf bag includes two supporting rods, two connecting members, a support base located on the ground, two strips, and a strip-holding member. Each connecting member is integrally formed on the upper end of an associated supporting rod. The upper end of each connecting member is pivotally connected to the golf bag and thus pivotable about a pivotal axis. Each connecting member further includes a receptacle extended in a direction parallel to the pivotal axis. Each strip includes an upper end securely attached to the receptacle of an associated connecting member to move therewith and a lower end securely attached to the support base. The strip-holding member is slidably attached to the strips to hold the strips and includes an upper end with two spaced inwardly facing notches. The strip-holding member further includes two spaced slots in a lower end thereof, each slot being communicated with outside via a slit.

15 Claims, 7 Drawing Sheets

SUPPORTING DEVICE FOR A GOLF BAG

BACKGROUND OF THE INVENTION

1. Field of the Invention

The present invention relates to a golf bag having an improved supporting device allowing smooth operation for supporting the golf bag in an inclined status.

2. Description of the Related Art

A typical golf bag may stand in an upright manner or be supported in an inclined status by a supporting device attached to the golf bag. FIG. 1 of the drawings illustrates a conventional supporting device for a golf bag 11. The supporting device includes two supporting rods 10, a support base 12, and two strips 13. Each supporting rod 10 has an upper end pivotally connected to the golf bag 11 by a pin 15. Each strip 13 includes an upper end attached to a hole 14 of a block 17 securely mounted to an upper portion of an associated supporting rod 10 and a lower end securely attached to the support base 12. A strip-holding block 16 is attached to the strips 13 to thereby hold the strips 13. Thus, the golf bag 11 may either stand in an upright manner (FIG. 2) or be supported in an inclined status (FIG. 3). Nevertheless, each supporting rod 10 must be drilled with two holes parallel to each other (one for mounting a pin 15 and the other for receiving the upper end of a strip 13) and such drilling is not easy and time-consuming. Pivotal movement of the supporting rods 10 to the position for supporting the golf bag 11 in an inclined status is difficult and not smooth if the two holes are not extended in a parallel manner. In addition, the block 16 is not adjustable and assembly of the strips 13 and the block 16 cannot be achieved easily, as the strips 13 must be passed through the block 16 before the strips 13 are attached to the supporting rods 10 and the base 12.

The present invention is intended to provide a supporting device for a golf bag that mitigates and/or obviate the above problems.

SUMMARY OF THE INVENTION

In accordance with the present invention, a supporting device for a golf bag comprises:

two supporting rods each having an upper end and a lower end, two connecting members each being integrally formed on the upper end of an associated said supporting rod, the upper end of each said connecting member being pivotally connected to the golf bag and thus pivotable about a pivotal axis, each said connecting member further including a receptacle extended in a direction parallel to the pivotal axis, a support base adapted to be located on the ground, two strips each including an upper end securely attached to the receptacle of an associated said connecting member to move therewith and a lower end securely attached to the support base, and a strip-holding member through which the strips extend, the strip-holding member being slidably attached to the strips to hold the strips, whereby the supporting rods are pivotable to a status for supporting the golf bag in an inclined status with the lower ends of the supporting rods located on the ground.

In a preferred embodiment of the invention, a supporting device for a golf bag comprises:

two supporting rods each having an upper end and a lower end, two connecting members each being integrally formed on the upper end of an associated said supporting rod, the upper end of each said connecting member including a pivotal hole pivotally connected to the golf bag by a pivotal pin, each said connecting member further including a receptacle extended in a direction parallel to a pivotal axis of the pivotal pin, a support base adapted to be located on the ground, two strips each including an upper end securely attached to the receptacle of an associated said connecting member to move therewith and a lower end securely attached to the support base, and a strip-holding member through which the strips extend, the strip-holding member being slidably attached to the strips to hold the strips, whereby the supporting rods are pivotable to a status for supporting the golf bag in an inclined status with the lower ends of the supporting rods located on the ground.

The strip-holding member includes an upper end with two spaced inwardly facing notches. The strip-holding member further includes two spaced slots in a lower end thereof, each slot being communicated with outside via a slit. Preferably, each connecting member is integrally formed on the associated supporting rod. Preferably, each connecting member includes an integrally formed wing in which an associated receptacle is defined.

Outward pivotal movement of the supporting rods and sliding movement of the strip-holding block can be achieved easily. Manufacture of the supporting device is simple. The strip-holding block may be attached to the strips after the strips are attached to the supporting rods and the support base.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
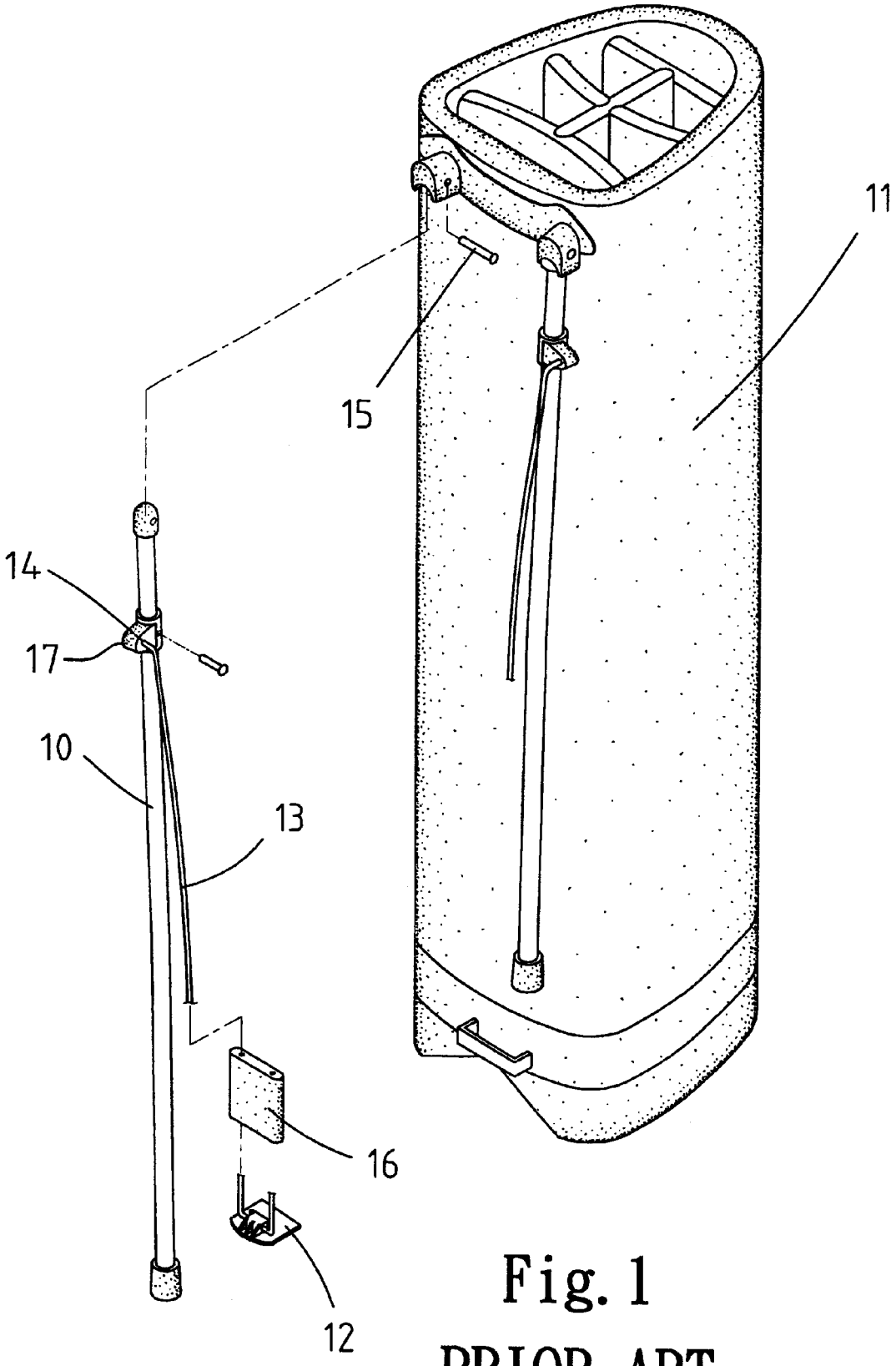
Fig. 1 PRIOR ART
FIG. 1 is a perspective view of a golf bag with a conventional supporting device.
Figure 2:
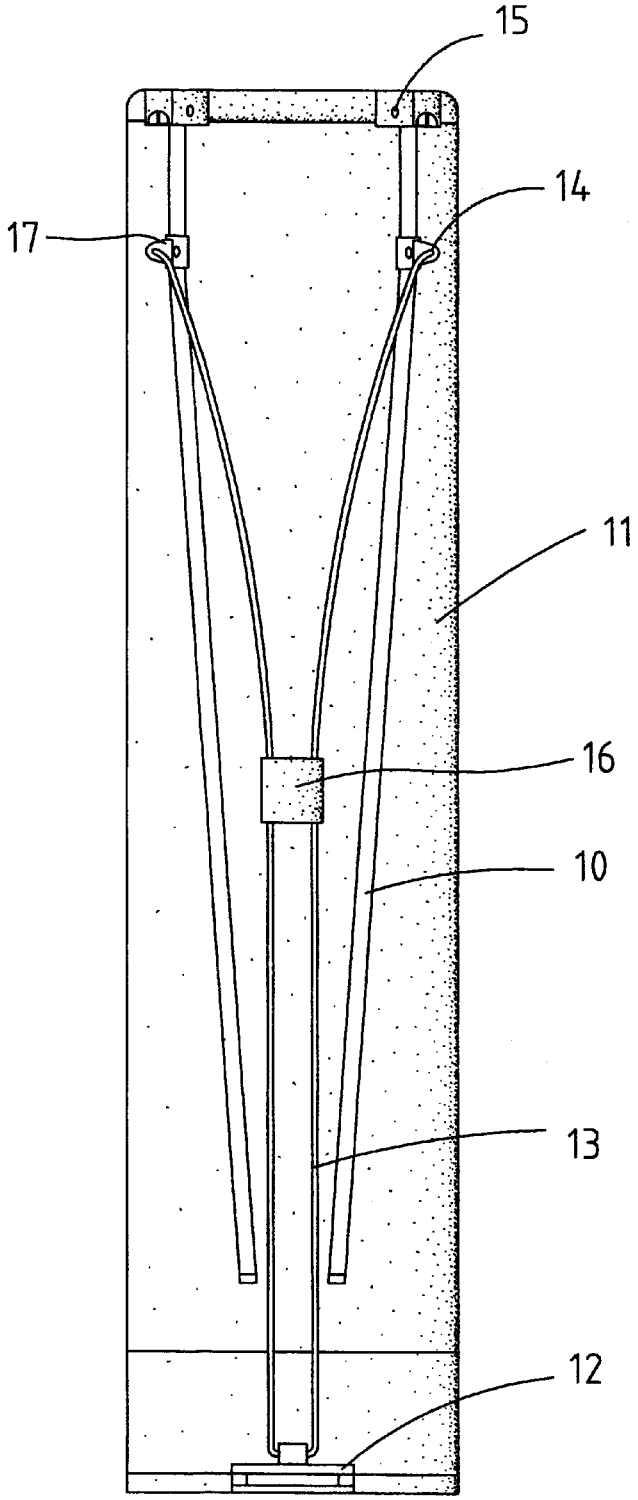
Fig. 2 PRIOR ART
FIG. 2 is a rear view of the golf bag in FIG. 1.
Figure 3:
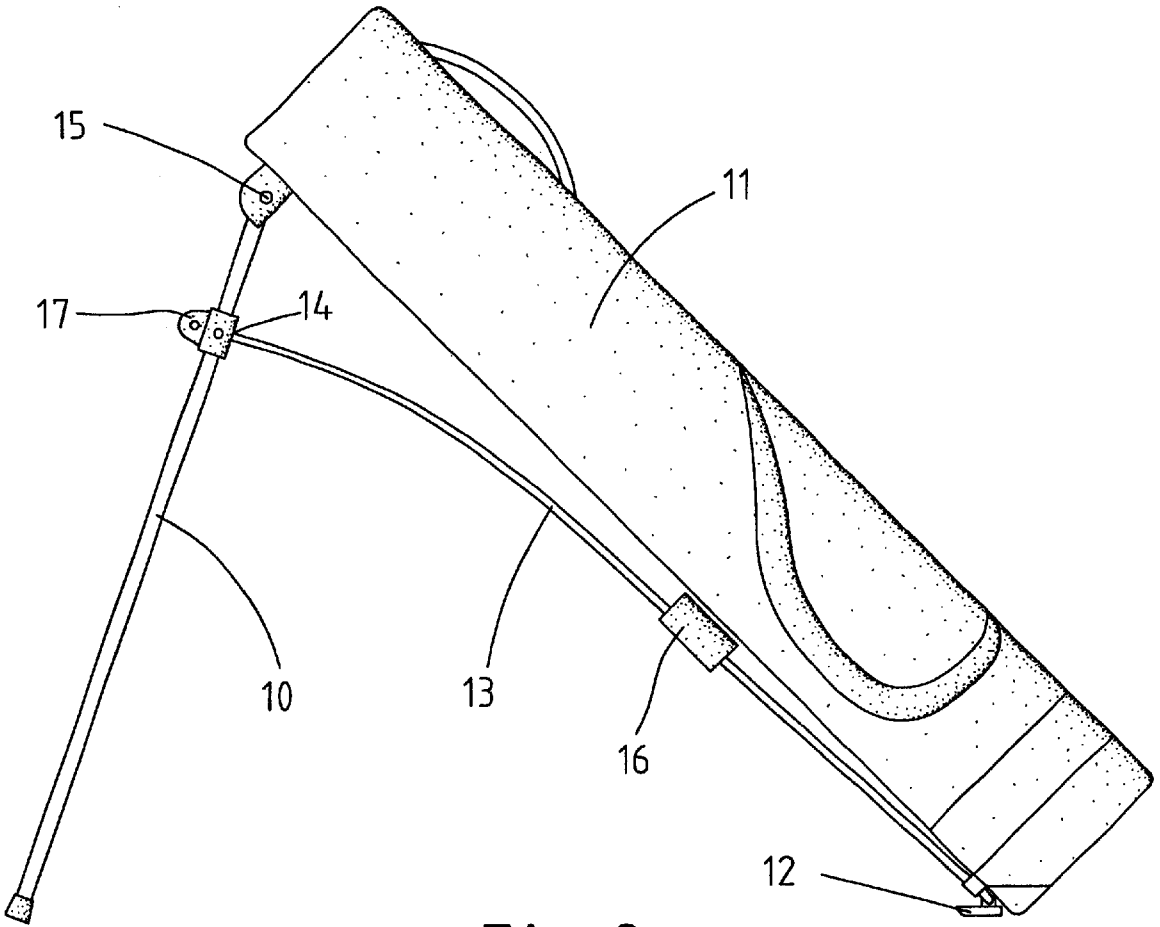
Fig. 3 PRIOR ART
FIG. 3 is a side view of the golf bag in FIG. 1, wherein the golf bag is supported in an inclined status.
Figure 4:
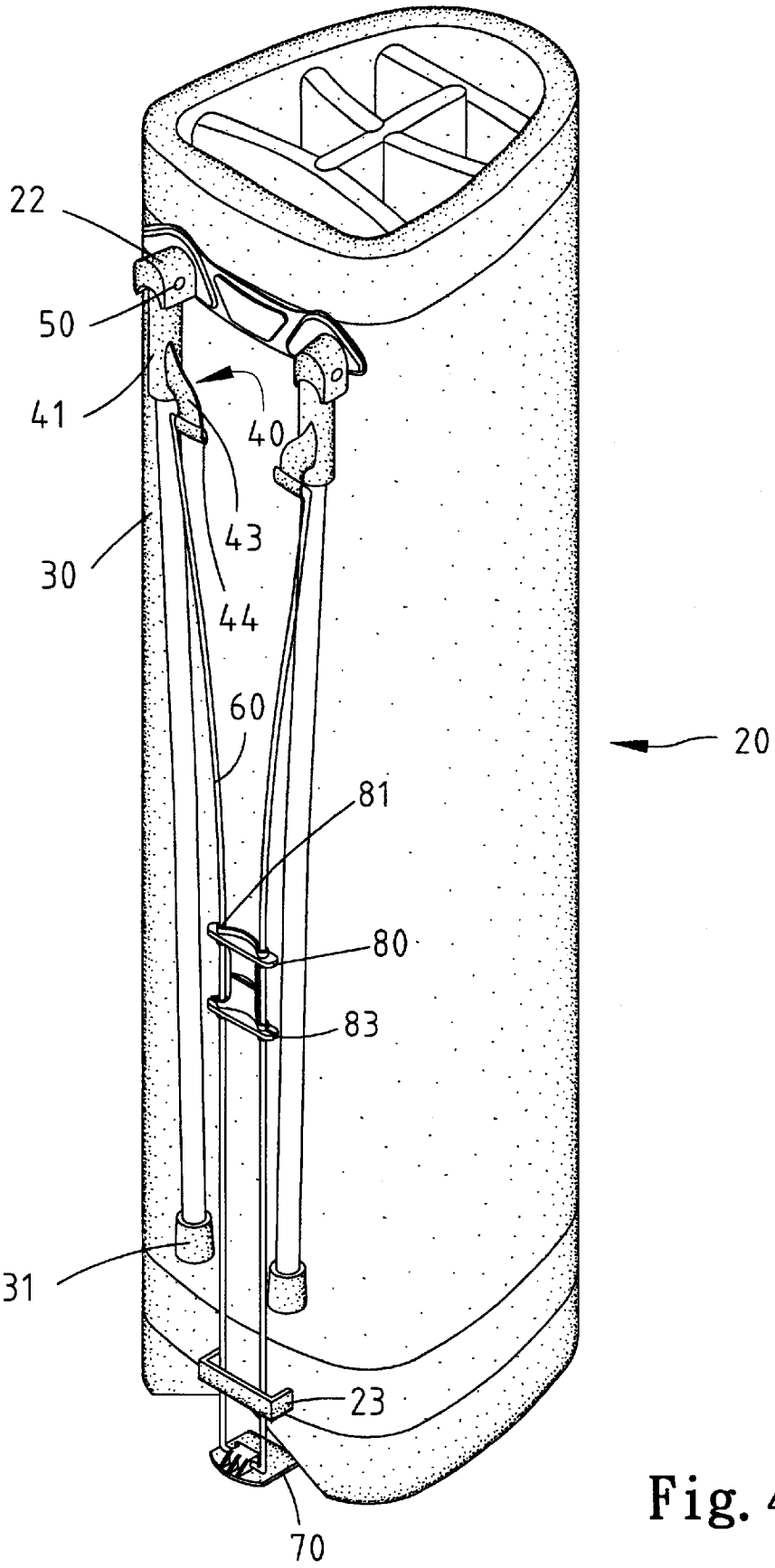
FIG. 4 is a perspective view of a golf bag with a supporting device in accordance with the present invention.
Figure 5:
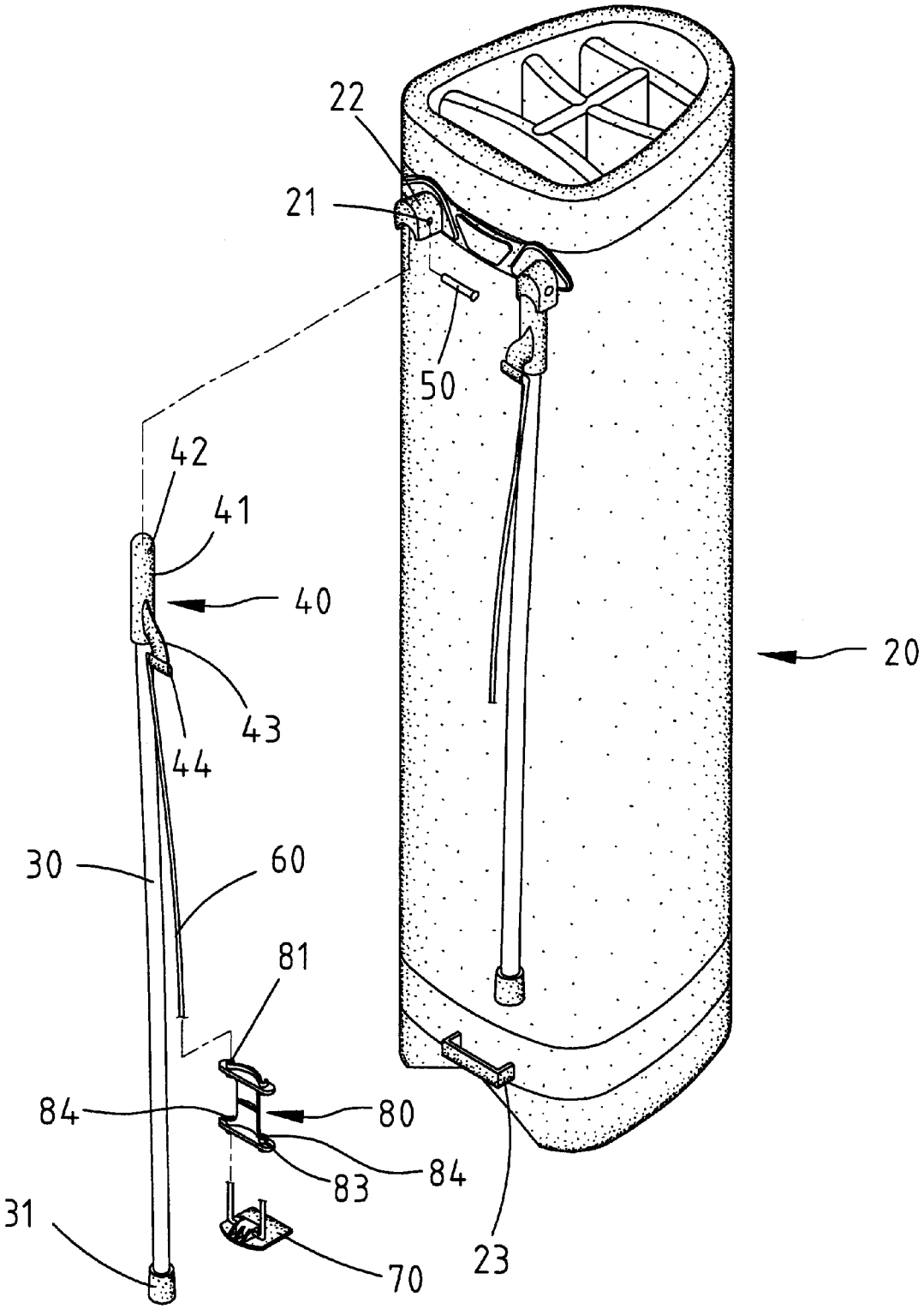
FIG. 5 is a perspective view, partly exploded, of the golf bag in FIG. 4.

Referring to FIGS. 4 through 7 and initially to FIGS. 4 and 5, a supporting device is provided for a golf bag 20 that includes two mounting seat 22 on an upper end thereof and a substantially U-shape restrainer 23. The supporting device in accordance with the present invention includes two supporting rods 30, two connecting means 40, two strips 60, a strip-holding member 80, and a support base 70. Each supporting rod 30 includes a lower end 31 that may stand on the ground to support the golf bag 20 in an inclined status. Each connecting means 40 may be a connecting member 41 that is integrally formed on an upper end of an associated supporting rod 30. Each connecting member 41 includes a pivotal hole 42 in an upper end thereof and a wing 43 extended from a lateral side thereof, the wing 43 including a receptacle 44. The wing 43 may be integrally formed on the connecting member 41 by injection molding. The receptacle 44 is parallel to the pivotal hole 42. A pivotal pin 50 is extended through a hole 21 in the mounting seat 22 and the pivotal hole 42 in the connecting member 41, thereby pivotally connecting the supporting rod 30 to the mounting seat 22.

Each strip 60 includes an upper end securely received in the receptacle 44 of an associated connecting member 41 and a lower end securely attached to the support base 70. The strip-holding member 80 is substantially I-shape and includes an upper end with two spaced inwardly facing notches 81. The strip-holding member 80 further includes two spaced slots 84 (FIG. 5) in a lower end thereof. Each slot 84 is communicated with outside via a slit 83. Each strip 60 is passed through an associated notch 81 and an associated slot 84. Thus, the strip-holding member 80 is slidably attached to the strips 60 to hold the strips 60 such that lower portions of the strips 60 are in an upright status.

Figure 6:
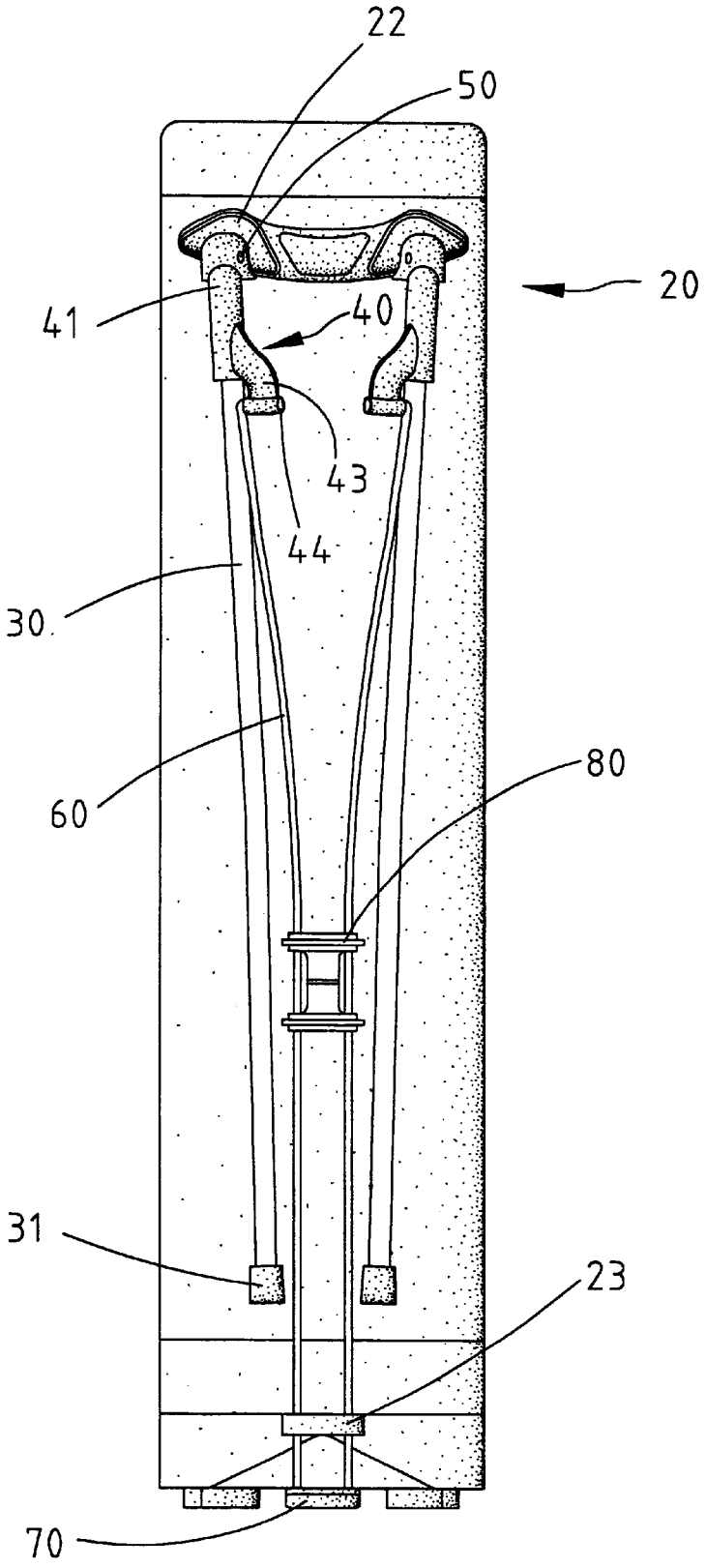
FIG. 6 is a rear view of the golf bag in FIG. 4.

As illustrated in FIGS. 4 and 6, the golf bag 20 may stand in an upright manner wherein lower portions of the strips 60 are guided by the restrainer 23. The support base 70 is located on the ground to provide assistance to stable support.

Figure 7:
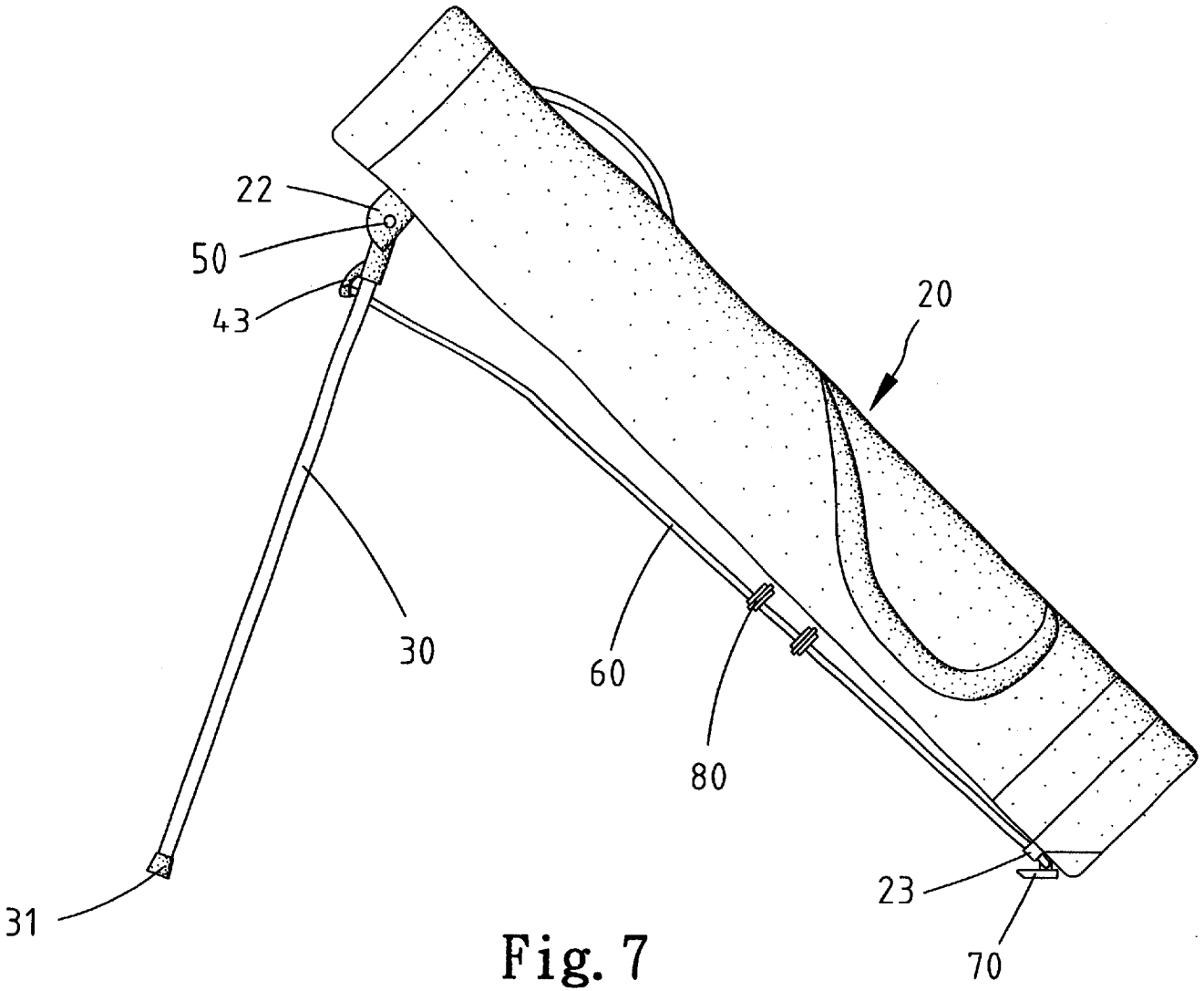
FIG. 7 is a side view of the golf bag in FIG. 4, wherein the golf bag is supported in an inclined status.

Referring to FIG. 7, the supporting rods 30 may be pivoted outward to support the golf bag 20 in an inclined status by the lower ends 31. The support base 70 is still located on the ground to provide a stable support. Each wing 43 is also pivoted while the receptacle 44 to which a strip 60 is attached is kept parallel to the pivotal pin 50. Thus, the strips 60 may be moved smoothly during outward pivotal movement of the supporting rods 30. The strip-holding block 80 is slid upward rapidly to keep the strips 60 straight.

According to the above description, it is appreciated that outward pivotal movement of the supporting rods 30 and sliding movement of the strip-holding block 80 can be achieved easily. Manufacture of the supporting device (i.e., injection molding) is simple. The strip-holding block 80 may be attached to the strips 60 after the strips 60 are attached to the supporting rods 30 and the support base 70.

Although the invention has been explained in relation to its preferred embodiment, it is to be understood that many other possible modifications and variations can be made without departing from the spirit and scope of the invention as hereinafter claimed.

What is claimed is:

1. A supporting device for a golf bag, comprising:

two supporting rods each having an upper end and a lower end, the upper end of each said supporting rod being adapted to be pivotally connected to the golf bag and thus pivotable about a pivotal axis, a support base adapted to be located on the ground, two strips each including an upper end securely attached to an upper portion of an associated said supporting rod to move therewith and a lower end securely attached to the support base, and a strip-holding member through which the strips extend, the strip-holding member being slidably attached to the strips to hold the strips, wherein the supporting rods are pivotable to a status adapted to support the golf bag in an inclined status with the lower ends of the supporting rods located on the ground; and wherein the strip-holding member includes an upper end with two spaced inwardly facing notches, the strip-holding member further including two spaced slots in a lower end thereof, and each said slot being communicated with outside via a slit.

2. The supporting device as claimed in claim 1, further comprising: a receptacle extended in a direction parallel to the pivotal axis for each of said two supporting rods, with the upper end of each said two strips being securely attached to the receptacle of the associated said supporting rod.

3. The supporting device as claimed in claim 2, further comprising: a connecting member formed on the upper end of each supporting rod, with the supporting rod being adapted to be pivotally connected to the golf bag by an upper end of the connecting member being adapted to be pivotally connected to the golf bag.

4. The supporting device as claimed in claim 3 wherein the upper end of the connecting member includes a pivotal hole and is adapted to be pivotally connected to the golf bag by a pivotal pin received in the pivotal hole.

5. The supporting device as claimed in claim 4, wherein each said connecting member is integrally formed on the associated supporting rod.

6. The supporting device as claimed in claim 5, wherein each said connecting member includes an integrally formed wing in which an associated said receptacle is defined.

7. The supporting device as claimed in claim 3, wherein each said connecting member is integrally formed on the associated supporting rod.

8. The supporting device as claimed in claim 7, wherein each said connecting member includes an integrally formed wing in which an associated said receptacle is defined.

9. The supporting device as claimed in claim 3, wherein each said connecting member includes an integrally formed wing in which an associated said receptacle is defined.

10. The supporting device as claimed in claim 1, further comprising: a connecting member formed on the upper end of each supporting rod, with the supporting rod being adapted to be pivotally connected to the golf bag by an upper end of the connecting member being adapted to be pivotally connected to the golf bag.

11. The supporting device as claimed in claim 10 wherein the upper end of the connecting member includes a pivotal hole and is adapted to be pivotally connected to the golf bag by a pivotal pin received in the pivotal hole.

12. The supporting device as claimed in claim 11, wherein each said connecting member is integrally formed on the associated supporting rod.

13. The supporting device as claimed in claim 10, wherein each said connecting member is integrally formed on the associated supporting rod.

14. A supporting device for a golf bag, comprising:

two supporting rods each having an upper end and a lower end, two connecting members each being integrally formed on the upper end of an associated said supporting rod, the upper end of each said connecting member including a pivotal hole adapted to be pivotally connected to the golf bag by a pivotal pin, each said connecting member further including a receptacle extended in a direction parallel to a pivotal axis of the pivotal pin, a support base adapted to be located on the ground, two strips each including an upper end securely attached to the receptacle of an associated said connecting member to move therewith and a lower end securely attached to the support base, and a strip-holding member through which the strips extend, the strip-holding member being slidably attached to the strips to hold the strips, whereby the supporting rods are pivotable to a status adapted to support the golf bag in an inclined status with the lower ends of the supporting rods located on the ground; and wherein the strip-holding member includes an upper end with two spaced inwardly facing notches, the strip-holding member further including two spaced slots in a lower end thereof, and each said slot being, communicated with outside via a slit.

15. The supporting device as claimed in claim 14, wherein each said connecting member includes an integrally formed wing in which an associated said receptacle is defined.

* * * * *